US008217668B2

(12) United States Patent
Park et al.

(10) Patent No.: US 8,217,668 B2
(45) Date of Patent: Jul. 10, 2012

(54) METHOD FOR EVALUATION OF THE GROUND REINFORCEMENT EFFECT USING 4-D ELECTRICAL RESISTIVITY MONITORING

(75) Inventors: Sam-Gyu Park, Daejeon (KR); Jung-Ho Kim, Daejeon (KR); Myeung-Jong Yi, Daejeon (KR); Seong-Jun Cho, Daejeon (KR)

(73) Assignee: Korea Institute of Geoscience & Mineral Resources, Daejeon (KR)

( * ) Notice: Subject to any disclaimer, the term of this patent is extended or adjusted under 35 U.S.C. 154(b) by 317 days.

(21) Appl. No.: 12/518,024

(22) PCT Filed: Mar. 27, 2009

(86) PCT No.: PCT/KR2009/001570

§ 371 (c)(1), (2), (4) Date: Jun. 5, 2009

(87) PCT Pub. No.: WO2009/120035

PCT Pub. Date: Oct. 1, 2009

(65) Prior Publication Data

US 2010/0315103 A1 Dec. 16, 2010

(30) Foreign Application Priority Data

Mar. 28, 2008 (KR) ..... 10-2008-0028758

(51) Int. Cl.
*G01R 27/08* (2006.01)
*G01V 3/00* (2006.01)

(52) U.S. Cl. ..... 324/693; 324/704; 324/347

(58) Field of Classification Search ..... 324/691, 324/693, 704, 347
See application file for complete search history.

(56) References Cited

U.S. PATENT DOCUMENTS 3,319,158 A * 5/1967 McDoulett et al. ..... 324/357
4,296,379 A * 10/1981 Yoshizumi ..... 324/357
4,875,015 A * 10/1989 Ward ..... 324/323
6,236,211 B1 * 5/2001 Wynn ..... 324/365

FOREIGN PATENT DOCUMENTS

SU 948345 * 8/1982

* cited by examiner

*Primary Examiner* — Timothy J Dole
(74) *Attorney, Agent, or Firm* — Patterson Thuente Christensen Pedersen, P.A.

(57) ABSTRACT

Disclosed is a method of evaluating a ground reinforcement effect using 4-D electrical resistivity monitoring, wherein the ground reinforcement is made up on an underground cavity through cement mortar grouting, the method including: (a) installing a survey line for measuring electrical resistivity in a ground reinforcement zone; (b) measuring the electrical resistivity of the ground reinforcement zone through the survey line before grouting mortar, and imaging three-dimensional electrical resistivity distribution in the ground reinforcement zone by applying a three-dimensional electrical resistivity inversion to the measured results; (c) measuring the electrical resistivity of the ground reinforcement zone through the survey line while or after grouting the mortar, and imaging the three-dimensional electrical resistivity distribution in the ground reinforcement zone by applying the three-dimensional electrical resistivity inversion to the measured results; and (d) calculating a change ratio of the electrical resistivity measured while or after the grouting in (c) to the electrical resistivity measured before the grouting in (b), and evaluating the ground reinforcement effect by imaging the three-dimensional electrical resistivity distribution in the ground reinforcement zone on the basis of the change ratio.

4 Claims, 16 Drawing Sheets

【Figure 1】
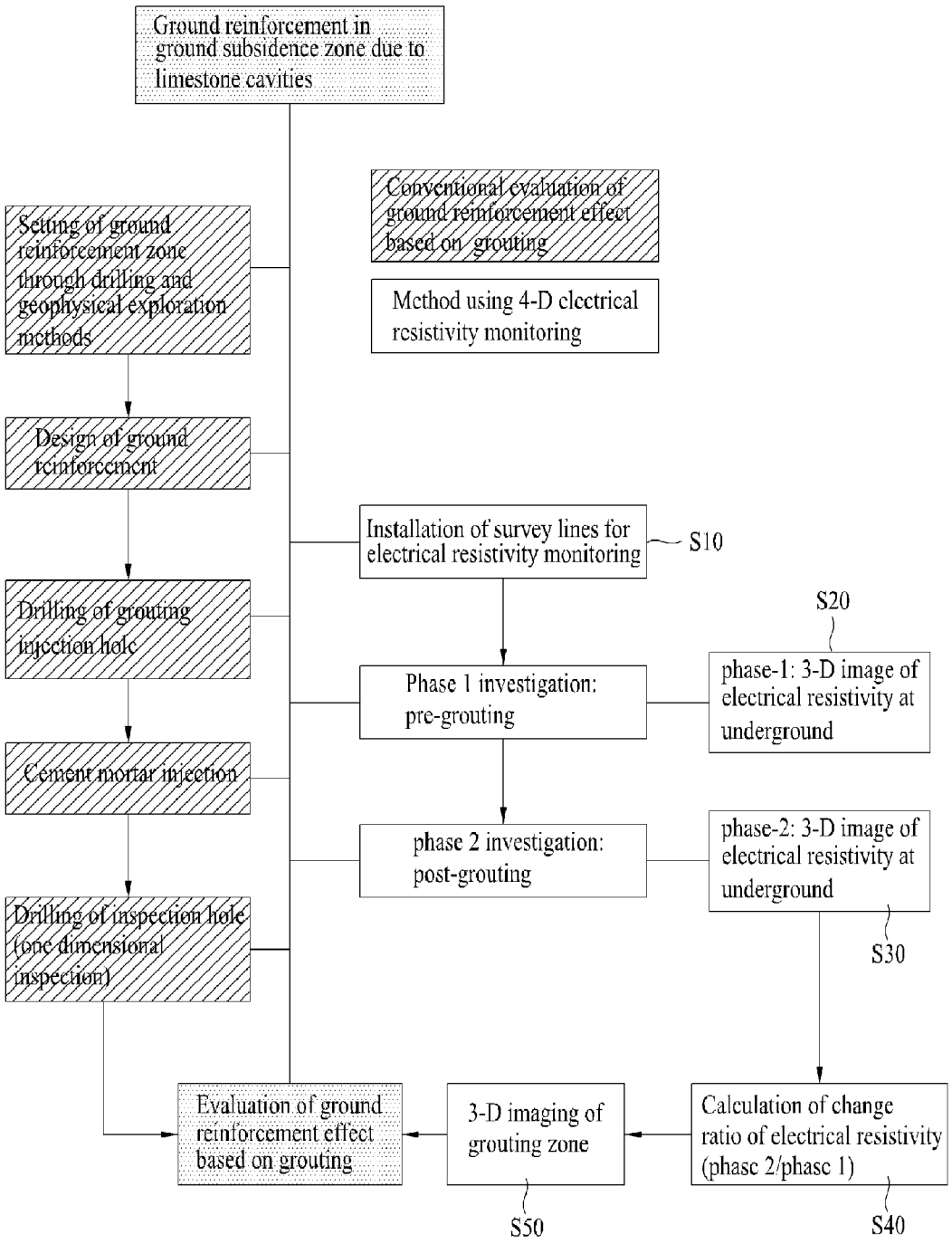

【Figure 2】
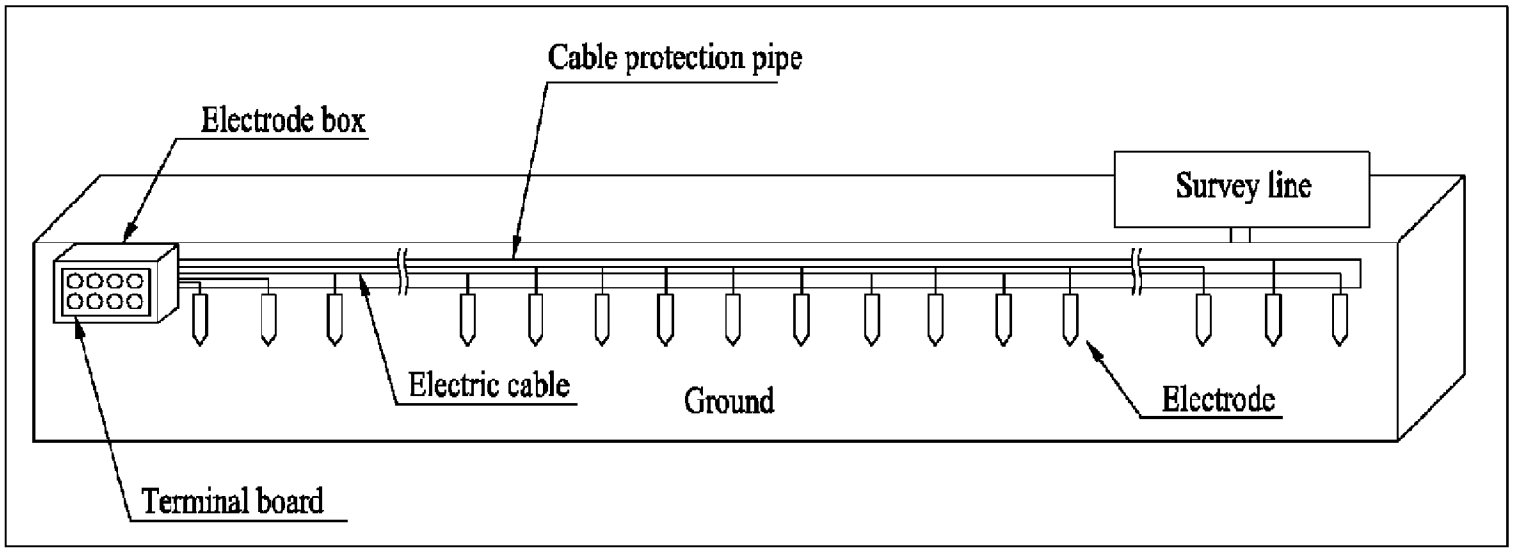

【Figure 3】
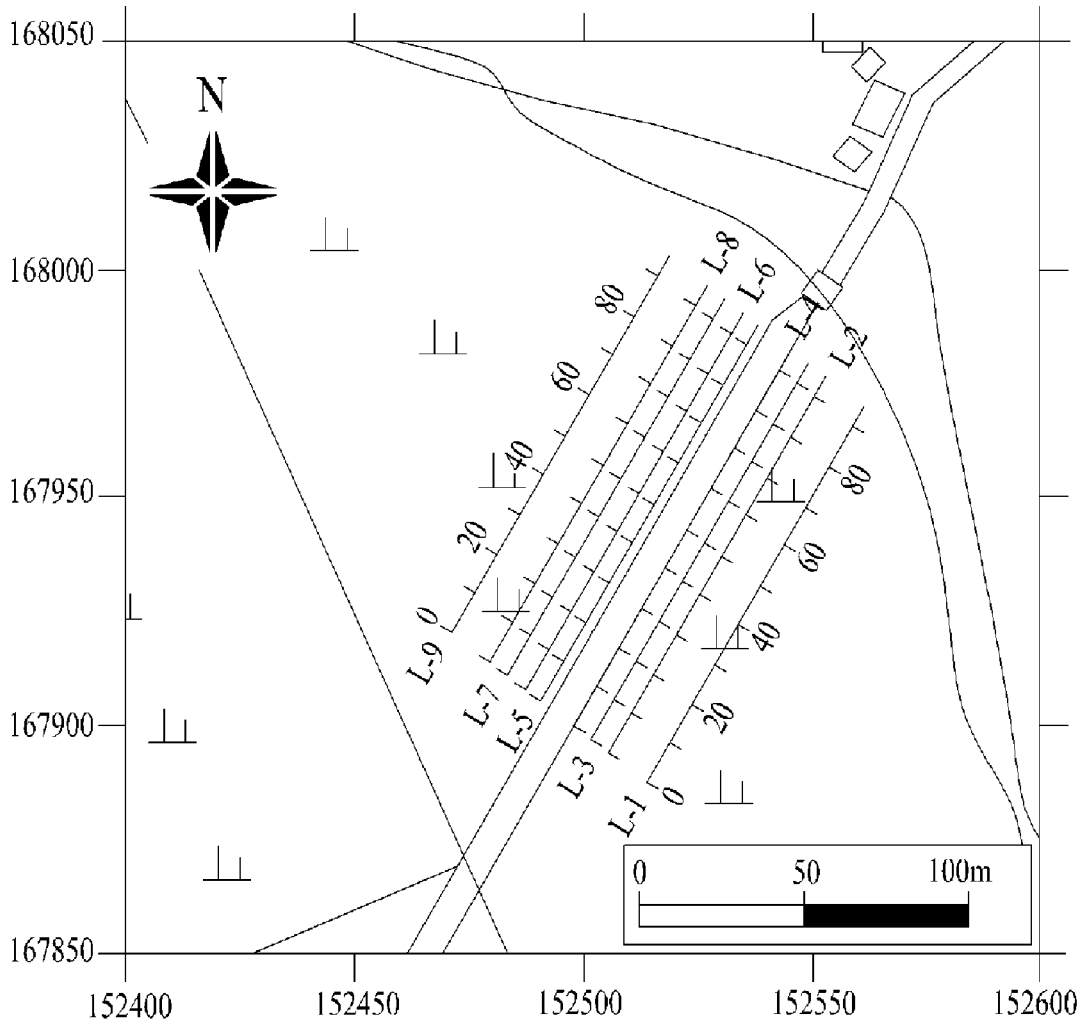

【Figure 4】
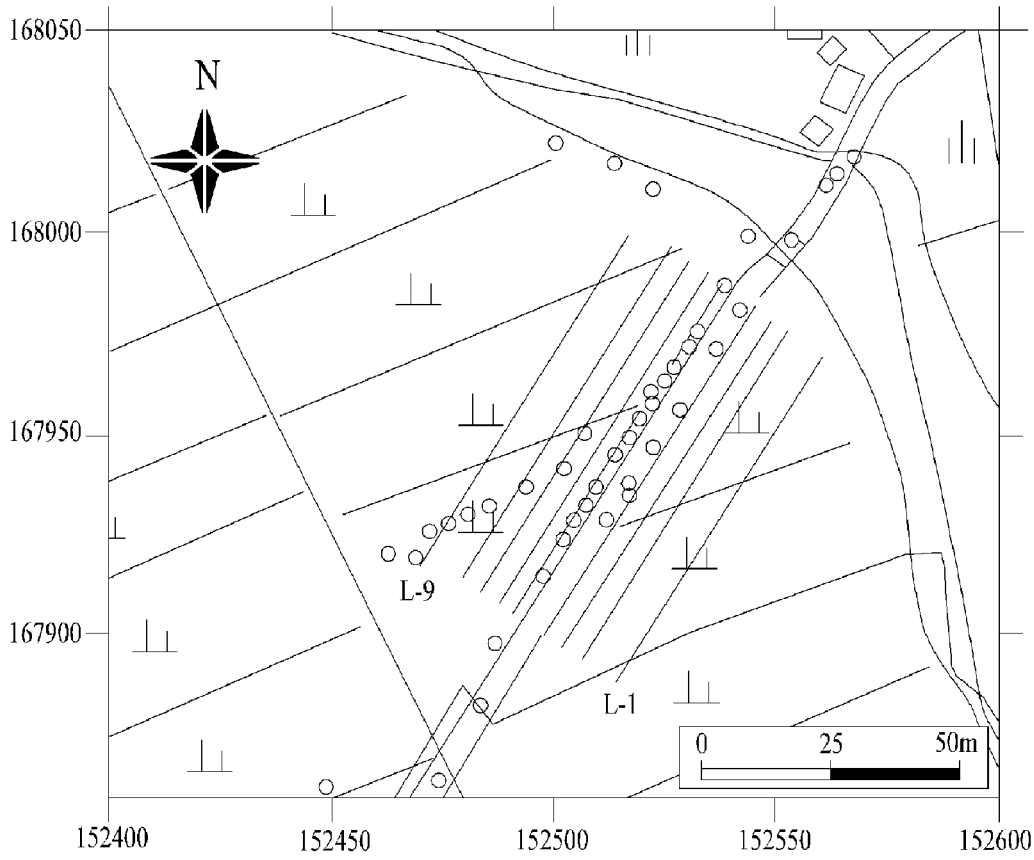

【Figure 5】
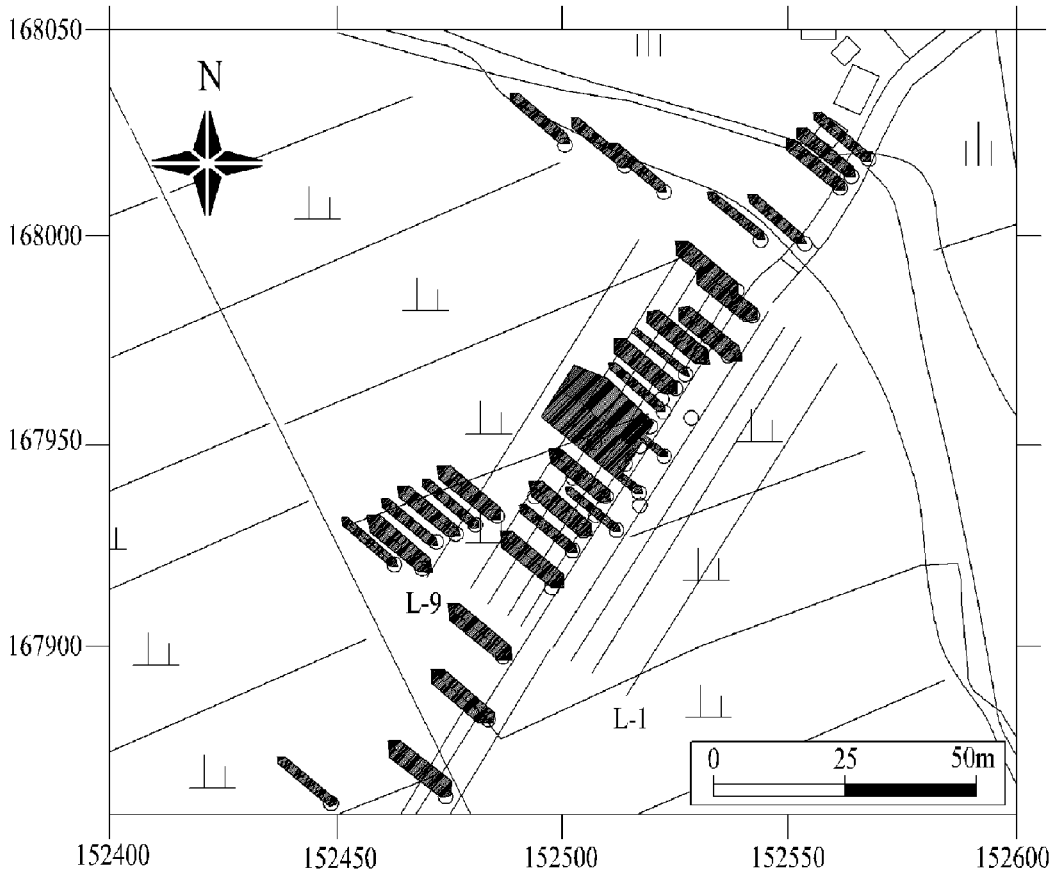

【Figure 6】
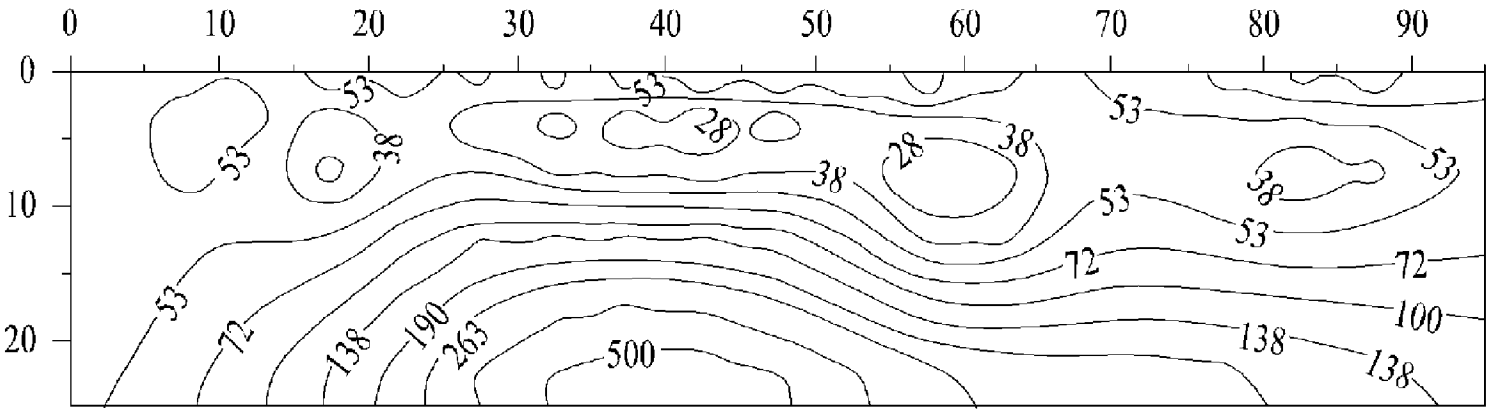

【Figure 7】
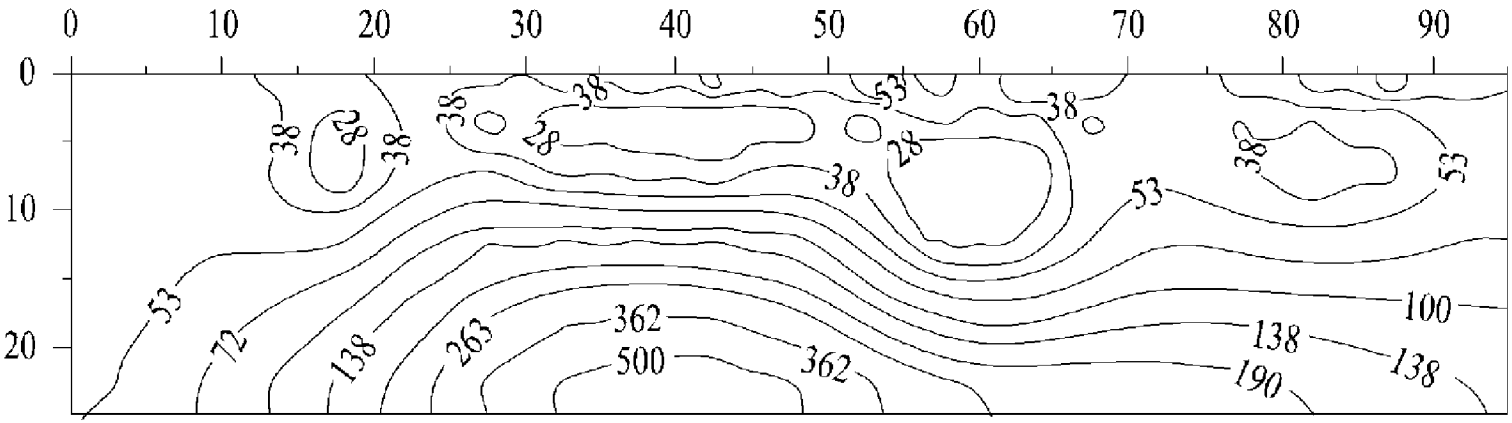

【Figure 8】
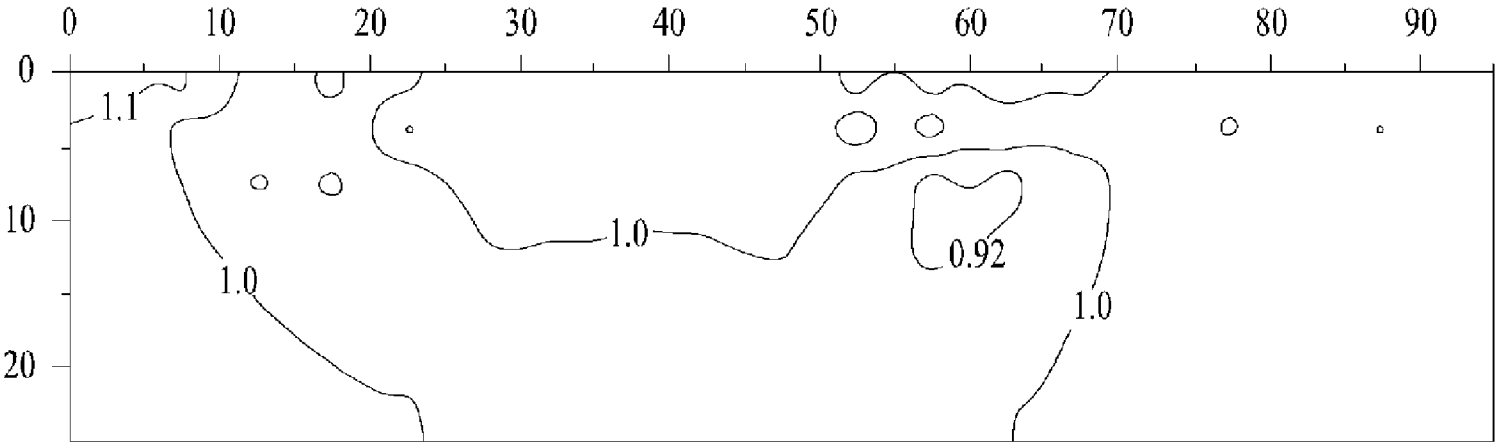

【Figure 9】
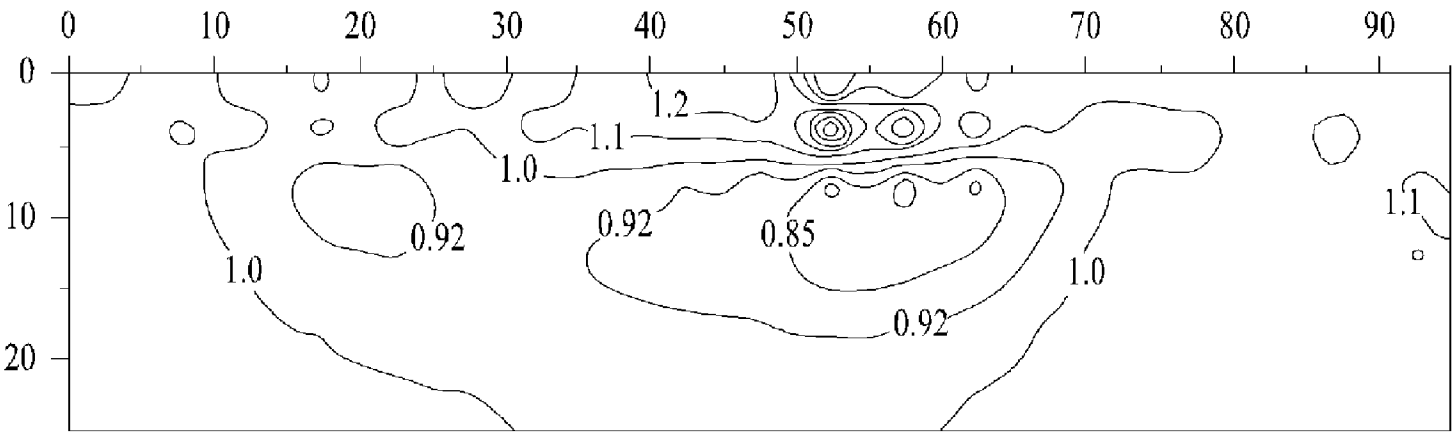

【Figure 10】
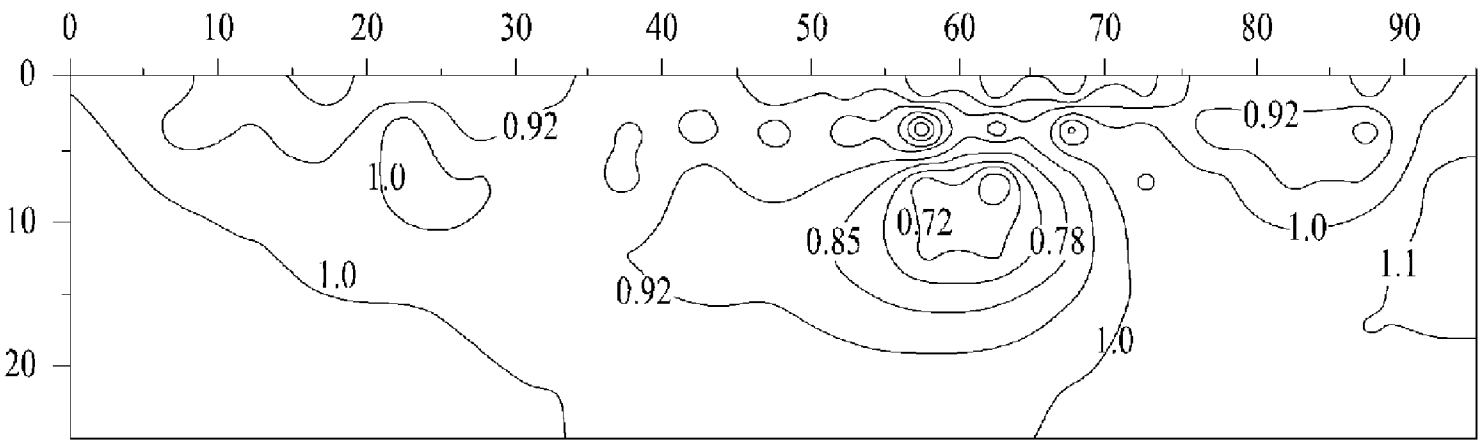

【Figure 11】
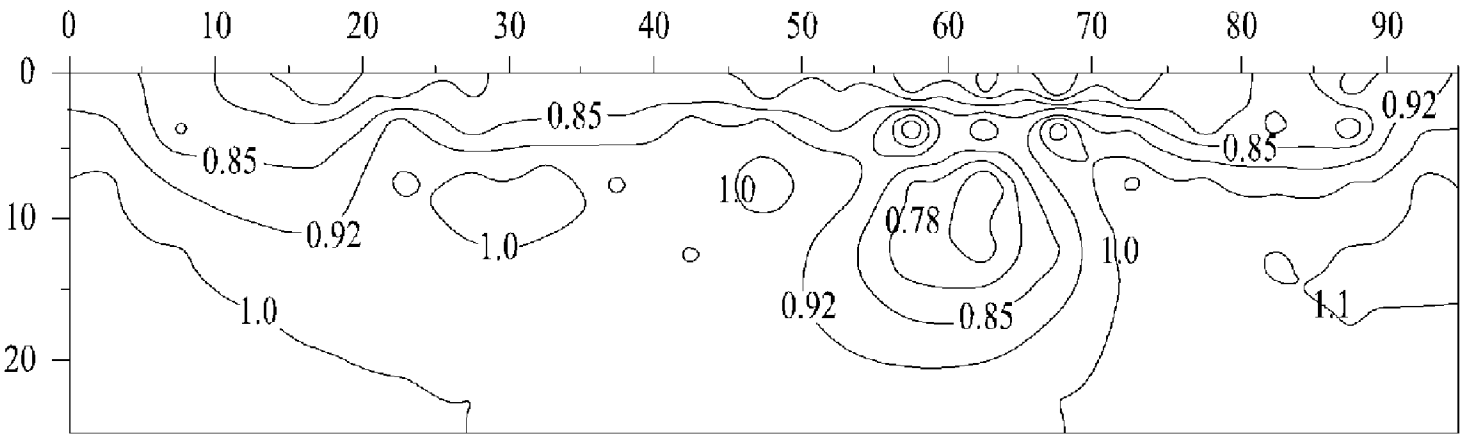

【Figure 12】
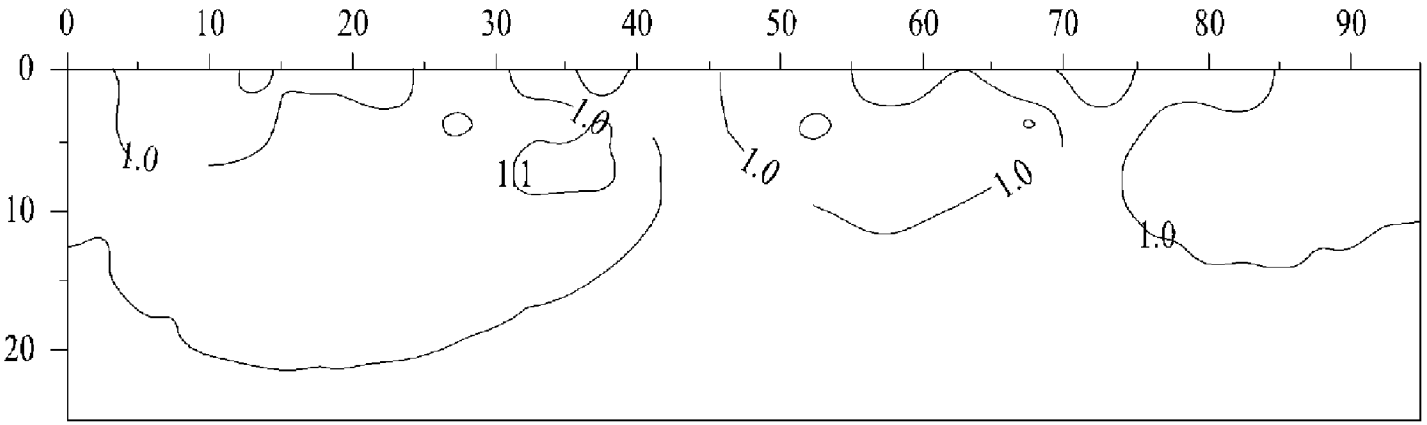

【Figure 13】
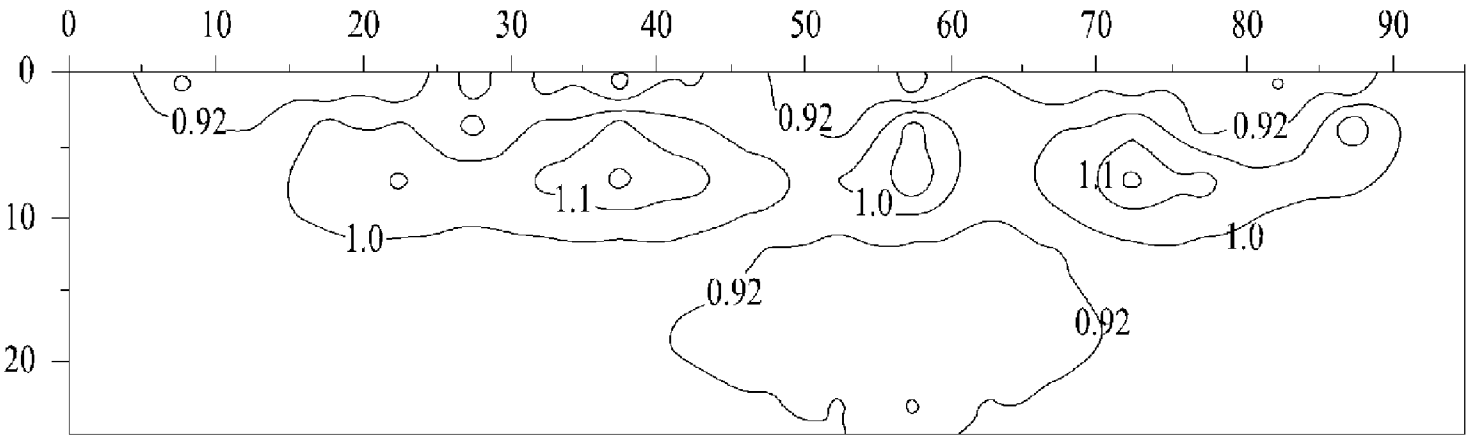

【Figure 14】
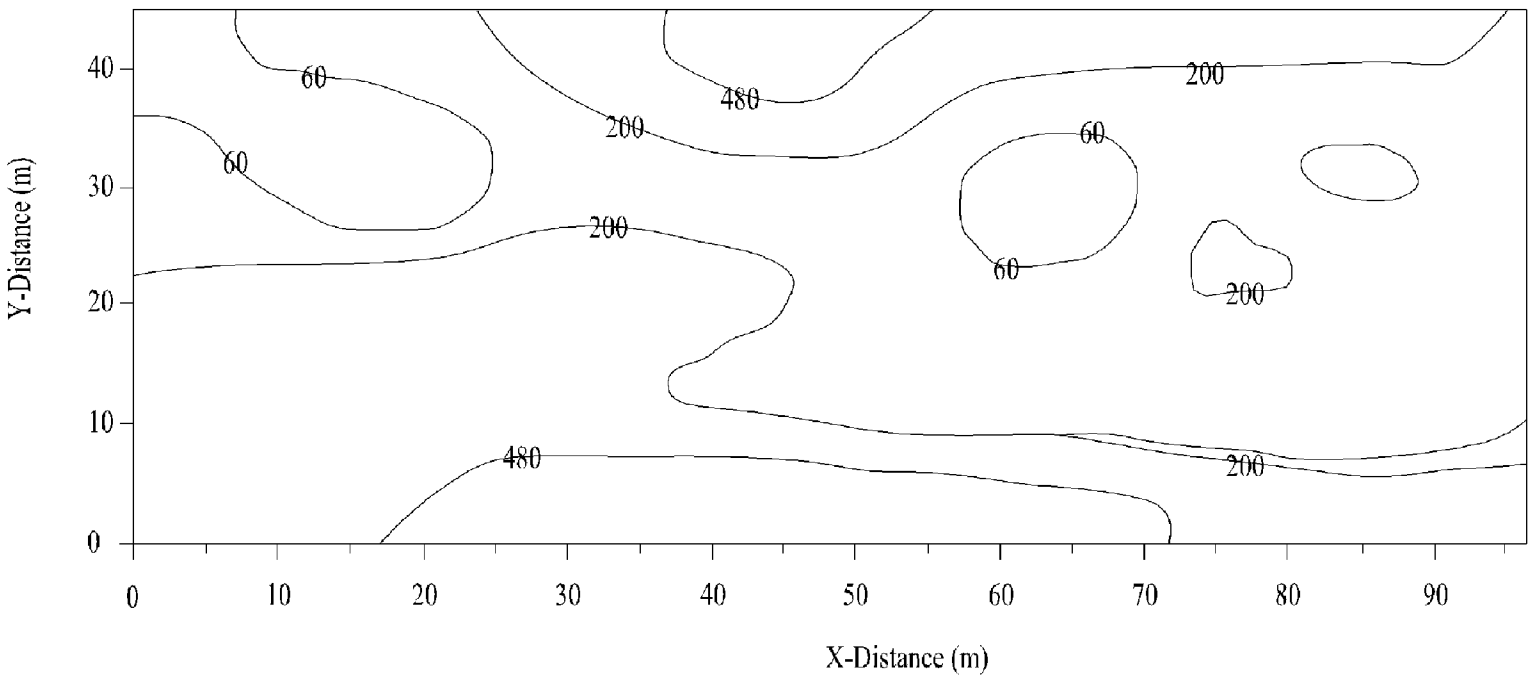

【Figure 15】
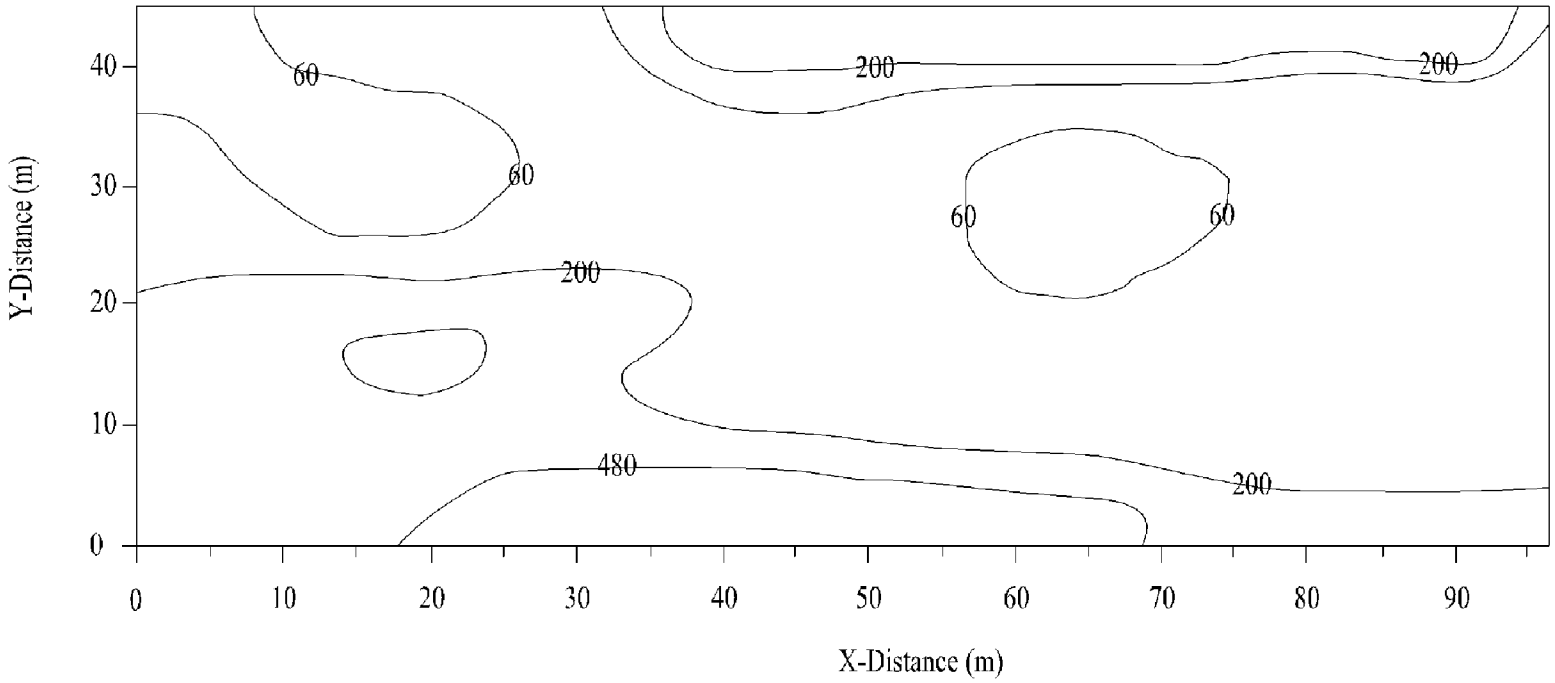

【Figure 16】
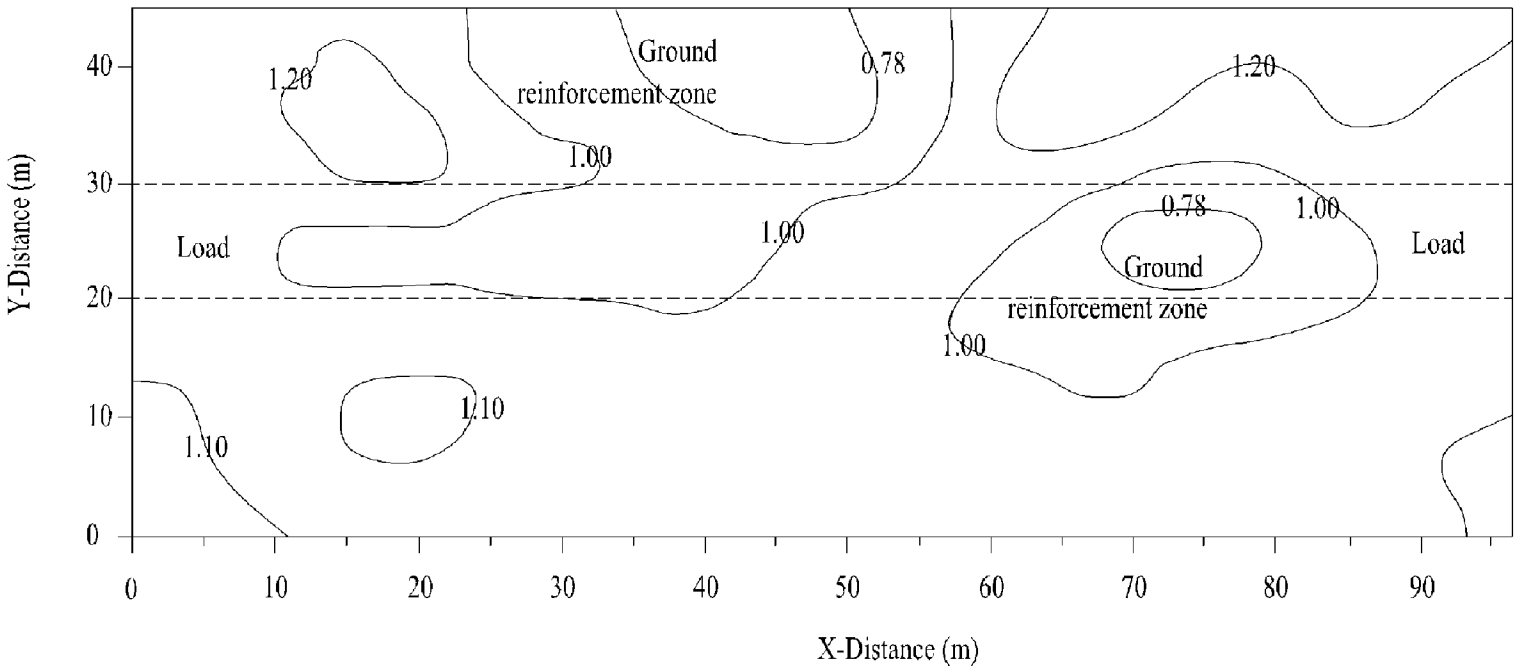

METHOD FOR EVALUATION OF THE GROUND REINFORCEMENT EFFECT USING 4-D ELECTRICAL RESISTIVITY MONITORING

TECHNICAL FIELD

The present invention relates to a method for evaluation of the ground reinforcement effect using 4-D electrical resistivity monitoring, and more particularly, to a method of evaluating a ground reinforcement effect on an underground cavity, based on cement mortar grouting through 4-D electrical resistivity monitoring.

BACKGROUND ART

A plurality of unspecified cavities such as a corrosion cavity of a limestone zone, an artificial cavity of an abandoned mine, etc. has increasingly caused damage to human life and social overhead capital including an above ground structure such as a road, a railroad and a bridge. Particularly, a construction site is in many difficulties such as a great expense for changing the existing design and preparing new countermeasures to avoid an underground cavity, and so on. Thus, a ground reinforcement to a ground subsidence zone has emerged as an important issue.

The ground reinforcement to the limestone zone has been designed and constructed within a range of economically securing the stability of the existing facilities or a structure to be newly build rather than reinforcing the ground with regard to the whole cavity. To prevent the ground subsidence of the dangerous zone and secure the stability of the structure, an underground-cavity filling method based on cement mortar grouting has been mostly used in Korea.

DISCLOSURE

Technical Problem

Since most limestone cavity formed by chemical corrosion is irregularly developed, the cement mortar grouting is not easy to evaluate effects in the midst of the ground reinforcement and effects after the ground reinforcement. In general, the ground reinforcement effect is evaluated using drilling investigations and drill holes. However, this effect evaluation is disadvantageous in that not only it is confined to drilling sites but also it involves high drilling costs and needs much time.

To solve the foregoing problems, the present invention aims to provide a new method of effectively evaluating a ground reinforcement effect at a low cost throughout a reinforcement zone in the case where a cement mortar grouting method is used for reinforcing the ground having an underground cavity.

Technical Solution

The foregoing and/or other aspects can be achieved by providing a method of evaluating a ground reinforcement effect using 4-D electrical resistivity monitoring, wherein the ground reinforcement is made up on an underground cavity through cement mortar grouting, the method including: (a) installing a survey line for measuring electrical resistivity in a ground reinforcement zone; (b) measuring the electrical resistivity of the ground reinforcement zone through the survey line before grouting mortar, and imaging three-dimensional electrical resistivity distribution in the ground reinforcement zone by applying a three-dimensional electrical resistivity inversion to the measured results; (c) measuring the electrical resistivity of the ground reinforcement zone through the survey line while or after grouting the mortar, and imaging the three-dimensional electrical resistivity distribution in the ground reinforcement zone by applying the three-dimensional electrical resistivity inversion to the measured results; and (d) calculating a change ratio of the electrical resistivity measured while or after the grouting in (c) to the electrical resistivity measured before the grouting in (b), and evaluating the ground reinforcement effect by imaging the three-dimensional electrical resistivity distribution in the ground reinforcement zone on the basis of the change ratio.

The evaluation of the ground reinforcement effect may include evaluating the ground reinforcement effect in the ground reinforcement zone by comparing the electrical resistivity of pre-reinforcement and the electrical resistivity of post-reinforcement on the basis of a characteristic that the electrical resistivity of the mortar is lower than the electrical resistivity of underground water existing in a limestone cavity.

The survey line may be achieved by installing electrodes at regular intervals on bottoms dug at a predetermined depth from the surface of the ground, and connecting electric cables with each electrode through a cable protection pipe to ground the electrode to a terminal board. Further, a connection part between the electrode and the electric cable may be insulated and waterproofed with silicon.

Advantageous Effects

According to an exemplary embodiment of the present invention, it is possible to effectively evaluate a ground reinforcement effect at a low cost throughout a reinforcement zone in the case where a cement mortar grouting method is used for reinforcing the ground having an underground cavity.

DESCRIPTION OF DRAWINGS

FIG. 1 shows a configuration for a method of evaluating a ground reinforcement effect using 4-D electrical resistivity monitoring according to an exemplary embodiment of the present invention in contrast with a conventional method.

FIG. 2 shows an electrical resistivity measuring system according to an exemplary embodiment of the present invention.

FIG. 3 shows a zone where an electrical resistivity survey line is installed for evaluating the ground reinforcement effect FIG. 4 shows positions of cement mortar grouting holes for ground reinforcement in a road widening section.

FIG. 5 shows a cement mortar grouting amount of each cement mortar grouting hole.

FIGS. 6 and 7 show distributions of electrical resistivity analyzed by applying 4-D inversion to data obtained in a survey line six for electrical resistivity monitoring.

FIGS. 8 to 11 show change ratios of electrical resistivity obtained in respective phases regarding a phase 1 as a criterion before grouting cement mortar with respect to the survey line six the most affected by the cement mortar grouting.

FIGS. 12 and 13 show change ratios of electrical resistivity obtained in respective phases regarding a phase 1 as a criterion before grouting cement mortar with respect to the survey line four little affected by the cement mortar grouting.

FIGS. 14 to 16 show 3-D inverse analysis results obtained from electrical resistivity monitoring data before and after the cement mortar grouting, and the electrical resistivity change ratios thereof.

BEST MODE

Hereinafter, a method of evaluating a ground reinforcement effect using 4-D electrical resistivity monitoring according to an exemplary embodiment of the present invention will be described with reference to accompanying drawings.

This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation, if used, indicate similar elements in alternative embodiments.

FIG. 1 shows a configuration for a method of evaluating a ground reinforcement effect according to an exemplary embodiment of the present invention.

As shown therein, there has been conventionally used a method of evaluating reinforcement effect by drilling an inspection hole to inspect the reinforcement effect after reinforcing the ground by a cement mortar grouting method in a ground subsidence zone due to a limestone cavity. However, the conventional method not only performs effect evaluation confined to drilling sites but also has disadvantages in that drilling is very expensive and it takes much time.

To solve the foregoing problem, the present invention provides a new technology of evaluating a ground reinforcement effect on the basis of a change ratio between electrical resistivity measured before and after carrying out reinforcement in a reinforcing zone.

According to an exemplary embodiment of the present invention, evaluation of a ground reinforcement effect is performed as follows.

First, at operation S10, a survey line to measure the electrical resistivity for a long time is installed in a ground reinforcement zone. Then, at operation S20, the electrical resistivity is measured using the survey line in regard to the reinforcement zone before grouting mortar, and a 3-D electrical resistivity inversion is applied to measured results, thereby imaging a 3-D electrical resistivity distribution regarding the reinforcement zone.

Then, at operation S30, the electrical resistivity according to respective certain states is measured using the survey line while or after grouting the mortar, and the 3-D electrical resistivity inversion is applied to measured results, thereby imaging the 3-D electrical resistivity distribution regarding the reinforcement zone.

Lastly, at operation S40 the change ratio between the electrical resistivity measured before the reinforcement and the electrical resistivity measured during or after the reinforcement is calculated, and at operation S50 the 3-D electrical resistivity distribution regarding the reinforcement zone is imaged on the basis of the change ratio of the electrical resistivity.

Since cement mortar has electrical resistivity lower than that of underground water filled in a limestone cavity even though the cement mortar varies in electrical resistivity according to its mix proportions (an indoor experimental result was that mortar has an electrical resistivity of 10 ohm-m), it is possible to three-dimensionally evaluate the ground reinforcement effect based on the cement mortar by imaging a part where the electrical resistivity is lowered after grouting the mortar. That is, the change ratio of the electrical resistivity before and after the reinforcement is a ratio of the electrical resistivity after the reinforcement to the electrical resistivity before the reinforcement. If the change ratio is lower than 1, it means that the electrical resistivity is lowered after grouting as compared with that before grouting. Thus, it is determined that the cement mortar grouting has an effect on lowering the electrical resistivity, so that a reinforcement effect based on the mortar in a relevant zone can be evaluated.

FIG. 2 shows an electrical resistivity measuring system placed in a ground reinforcement zone. In this embodiment, the survey lines for measuring the electrical resistivity may be achieved by installing electrodes on bottoms dug to a predetermined depth at regular intervals and connecting electric cables to each electrode through a cable protection pipe to ground the electrodes to a terminal board. In a practical system, the electrodes are installed at intervals of 5 m on the bottoms dug at a depth of 30 cm below the surface of the ground, and grounded to the terminal board by connecting with the electric cables through the cable protection pipes, respectively. Further, a connection part between the electrode and the electric cable is insulated and waterproofed with silicon so as to prevent corrosion due to air and water, and the electrodes are covered with dug earth after installing all the electrodes.

Below, using the method of evaluating the ground reinforcement effect using the 4-D electrical resistivity monitoring according to an exemplary embodiment of the present invention, a process of evaluating the reinforcement effect in a practical ground reinforcement zone will be described in the concrete.

A test zone is a zone that has undergone the ground subsidence in the past, in which lime-silicate rock is distributed as stone bedrock and is covered thereon with quaternary alluvial deposits including paddy soil. In this zone, a cavity, formed as the lime-silicate rock is corroded by underground water flowing along a fault fracture zone, has been developed throughout wide area in a relatively small scale at various depths. Thus, the test zone has a geological characteristic of being likely to subside since it is easy to flow the underground water therethrough. According to a conventional investigation result, it was turned out that a lime-silicate cavity distributed in the test zone has a net structure and is distributed throughout a wide area. Further, a tubular well was developed in the vicinity of the test zone, so that the underground water can be pumped up to supply agricultural water. For supplying the agricultural water during the farming season, this zone largely depends on the underground water. As the underground water is excessively pumped out, the level of the underground water filled in the underground cavity is lowered to thereby cause the ground subsidence several times.

To design the ground reinforcement for securing safety in a road widening section that passes through the zone with the developed lime-silicate cavity, drilling and physical investigations were implemented. In result, it was found out that the underground cavity has been developed below the road widening section. On the basis of this result, design and construction were achieved by the cement mortar grouting method so as to reinforce the ground under the road widening section.

According to results from the drilling investigations in the road widening section, the underground cavity is distributed from the surface of the ground to a depth of 18 m, which matches with a low resistivity zone of a 3-D electrical resistivity image.

In this experimental example of the electrical resistivity monitoring system, nine survey lines were installed with respect to the road widening section where the underground cavity of lime-silicate has been the most developed, and an electrode, an electric cable, etc. were specially manufactured. FIG. 3 shows electrical resistivity survey lines installed with respect to a ground reinforcement zone. In FIGS. 3 to 5, horizontal and vertical axes indicate TM coordinates. Referring to FIG. 3, nine electrical resistivity survey lines were installed in a direction of northeast-southwest, the electrodes were installed at intervals of 5 m, and the survey lines were installed at intervals of 5 m and 10 with respect to the road widening section.

Among nine electrical resistivity survey lines, the survey lines four, five and six were achieved by laying the electrodes under the ground at intervals of 5 m on the bottoms dug at a depth of 30 cm and grounding the electrodes to the terminal board by connection with the electric cables through the cable protection pipes, respectively, so that the electrical resistivity can be monitored for a long time. Further, the connection part between the electrode and the electric cable is insulated and waterproofed with silicon so as to prevent corrosion due to air and water, and the electrodes are covered with dug earth after installing all the electrodes. Besides, start and end points of the survey line were marked on the soil of a rice paddy, and the survey line was installed when there is no crop, thereby monitoring the electrical resistivity.

As shown in Table 1, the electrical resistivity was measured once before grouting the cement mortar for reinforcing the ground, and many times repetitively while and after grouting the cement mortar. The electrodes used in the measurement were set in a dipole-dipole array and a modify pole-pole array, and disconnection and grounding states were grasped by checking a ground resistance between the electrode and the ground. Using the same current (100 mA) and electrode arrays, the electric resistivity was measured with respect to each survey line.

TABLE 1

| Monitoring Phase | Obtainment Date | Grouting Condition |
|---|---|---|
| Phase 1 | 04 Feb. 2006 | Pre-grouting |
| Phase 2 | 17 Feb. 2006 | Start of grouting |
| Phase 3 | 07 Mar. 2006 | During injection |
| Phase 4 | 04 Apr. 2006 | During injection |
| Phase 5 | 05 May 2006 | Post-grouting |
| Phase 6 | 07 Jul. 2006 | Post-grouting |
| Phase 7 | 15 May 2007 | Post-grouting |

To reinforce the road having the developed limestone cavity thereunder with the cement mortar grouting, drilling investigations and electrical resistivity surveys were carried out. In result, it was determined that many underground cavities irregularly existed around the survey line six for the electrical resistivity monitoring and were distributed toward the survey lines seven and eight, and therefore positions of grouting holes were set as shown in FIG. 4. Referring to the positions of the grouting holes, the grouting holes concentrated on the vicinity of the survey line six for the electrical resistivity monitoring, in which the limestone cavity was found out during the drilling investigation with respect to the edge of the road, and the grouting holes were also positioned on the soil of a rice paddy corresponding to the survey lines seven and eight.

At initial grouting, cement suspension made by mixing water, cement and bentonite was injected into the grouting hole under a certain pressure. However, it was found out that the cement suspension flowed far away since the limestone cavity was developed having a net structure in this zone. The reason is that pressure is generally increased as the cement suspension is injected, but the pressure of this zone increases and then decreases as the cement suspension is injected. Accordingly, the cement mortar made by mixing the cement suspension with sands was used as a grout, and a grouting amount of each grouting hole was determined by the grouting pressure.

FIG. 5 shows a cement mortar grouting amount of each cement mortar grouting hole. In light of total grouting amount, there was a large amount of grouting in the drill hole where the limestone cavity was found out. Here, it is supposed that the grout flows throughout a wide range since the limestone cavity is developed as a net structure in the drill hole.

Applicability of evaluating the ground reinforcement effect was examined by many times obtaining and analyzing data from the electrical resistivity survey lines installed in the vicinity of the road widening section.

FIGS. 6 and 7 show results from analysis based on 4-D inversion applied to data obtained in the survey line six for electrical resistivity monitoring. In FIGS. 6 to 16, vertical and horizontal axes indicate a distance (unit: m); points of the same electrical resistivity (unit: ohm-m) are connected by a line; and a numeral written on the line of one electrical resistivity indicates electrical resistivity. It is regard that the survey line six, which is installed at the edge of the widening road, will be the most affected by the cement mortar grouting. FIG. 6 shows distribution of electrical resistivity in a phase 1 before grouting the cement mortar, and FIG. 7 shows distribution of electrical resistivity in a phase 6 after grouting the cement mortar. It will be appreciated that the electrical resistivity distribution patterns of the phase 1 and the phase 6 are almost similar to each other, but the low resistivity zone not more than 20 ohm-m is more expanded in the phase 6 than that in the phase 1. It is determined that the cause of the low resistivity zone expansion is based on the cement mortar injected as a grout.

As a result of observing change in the electrical resistivity according to the grouting amount in a basic experiment, it was turned out that the electrical resistivity decreases in proportion as the grouting amount increases. Accordingly, to evaluate the effect on the cement mortar grouting in the ground reinforcement, grouting behaviors as well as grouting zones were evaluated by obtaining a change ratio of the electrical resistivity measured in respective grouting phases. FIGS. 8 to 11 show change ratios of electrical resistivity obtained in the respective phases regarding a phase 1 as a criterion before grouting cement mortar with respect to the survey line six. FIGS. 8, 9, 10 and 11 show the change ratio of the electrical resistivity in the phases 2, 3, 4 and 6, respectively. FIG. 8 shows a phase of starting the grouting, in which there is little change in the electrical resistivity as compared with the electrical resistivity of the phase 1. However, in the case of the phases of 3, 4 and 6 in which the grouting is in progress, the zone where the electrical resistivity is lowered becomes expanded. Further, it will be appreciated that the low resistivity is as expanded near the surface of the ground as going from FIG. 9 to FIG. 11. In the phase 6, the surface of a road paved with asphalt was practically curved by the cement mortar grouting, the scene of which can be proved by the change ratio of the electrical resistivity.

FIGS. 12 and 13 show change ratios of electrical resistivity obtained in the phases 2 and 4 regarding a phase 1 as a criterion before grouting the cement mortar with respect to the survey line four installed at the edge of the widening road. FIGS. 12 and 13 show the change ratios of the electrical resistivity in the phases 2 and 4, respectively. Like FIGS. 8 to 11, FIG. 12 shows a phase of starting the grouting, in which there is little change in the electrical resistivity as compared with the electrical resistivity of the phase 1. FIG. 13 shows the change ratio of the electrical resistivity in the phase 4, in which the change in the electrical resistivity is seen as little. This is because the limestone cavity is not found out through the drilling investigation in the survey line four, and thus it appears that the cement mortar grouting is not performed.

To spatially grasp the grouting zone and behaviors of the cement mortar for the ground reinforcement, a 3-D inverse analysis was tried using nine survey lines for the electrical resistivity monitoring. FIGS. 14 to 16 show 3-D inverse analysis results obtained from electrical resistivity monitoring data before and after the cement mortar grouting, and the electrical resistivity change ratios thereof. FIG. 14 shows an electrical resistivity image at a depth of 15 m among the 3-D inverse analysis results in the phase 1, and FIG. 15 shows an electrical resistivity image at a depth of 15 m in the phase 7. FIG. 16 shows results obtained by just dividing the phase 7 by the phase 1, in which a part where low electrical resistivity is distributed is a zone where the electrical resistivity is lowered after the grouting than that before the grouting. From this result, it is possible to spatially grasp the flowing direction and distribution of the cement mortar grouting.

In this experimental example, it was tried to evaluate the ground reinforcement effect by carrying out the 4-D electrical resistivity monitoring in a site where the cement mortar grouting method is used for the ground reinforcement of the road widening section. The electrical resistivity was measured many times while and after grouting the cement mortar, and the flowing direction and the grouting range of the grout were determined on the basis of the change ratio of the measured electrical resistivity to the electrical resistivity obtained before grouting the cement mortar. In result, it was proved that the electrical resistivity was considerably lowered in the grouting hole around the zone with the developed limestone cavity, which was based on the effect of the grout. On the other hand, the survey line four for the electrical resistivity monitoring, in which the limestone cavity was not found out through the drilling investigations, showed that there was little change in the electrical resistivity and a remarkably small amount of grout was practically injected into the grouting hole.

Accordingly, it is possible to prove that the 4-D electrical resistivity monitoring is useful to evaluate the ground reinforcement effect of the cement grouting in the ground subsidence zone due to the limestone cavity. Further, it is possible to three-dimensionally image the ground reinforcement zone from the change ratio of the electrical resistivity between before and after injecting the grout in the ground subsidence zone, so that technology of monitoring change in physical properties of the ground according to the present invention can be usefully applied to a field of ground investigations.

As described above, various exemplary embodiments have been described with the drawings and the specifications. For reference, terms employed herein are not used for narrowing the meaning and limiting the scope of the invention. Accordingly, it will be appreciated by those skilled in the art that changes may be made in these exemplary embodiments without departing from the principles and spirit of the invention, the scope of which is defined in the appended claims and their equivalents.

The invention claimed is:

1. A method of evaluating a ground reinforcement effect using 4-D electrical resistivity monitoring, wherein the ground reinforcement is made up on an underground cavity through cement mortar grouting, the method comprising:

(a) installing a survey line for measuring electrical resistivity in a ground reinforcement zone;

(b) measuring the electrical resistivity of the ground reinforcement zone through the survey line before grouting mortar, and imaging three-dimensional electrical resistivity distribution in the ground reinforcement zone for a first time by applying a three-dimensional electrical resistivity inversion to the measured results;

(c) analyzing electrical resistivity data and images resulting from step (b) to determine that the ground reinforcement zone includes an underground cavity;

(d) selecting a grouting zone based on the electrical resistivity data, the images, and the location of the identified underground cavity;

(e) causing cement mortar to flow into grouting zone, including the identified underground cavity, thereby grouting the mortar;

(f) measuring the electrical resistivity of the ground reinforcement zone through the survey line while or after grouting the mortar, and imaging the three-dimensional electrical resistivity distribution in the ground reinforcement zone for a second time by applying the three-dimensional electrical resistivity inversion to the measured results; and (g) calculating a change ratio of the electrical resistivity measured while or after the grouting in (f) to the electrical resistivity measured before the grouting in (b), and evaluating the ground reinforcement effect by imaging the three-dimensional electrical resistivity distribution in the ground reinforcement zone on the basis of the change ratio.

2. The method according to claim 1, wherein the survey line is achieved by installing electrodes at regular intervals on bottoms dug to a predetermined depth from the surface of the ground and connecting electric cables to each electrode through a cable protection pipe to ground the electrodes to a terminal board.

3. The method according to claim 2, wherein a connection part between the electrode and the electric cable is insulated and waterproofed with silicon.

4. The method according to claim 1, wherein the evaluating the ground reinforcement effect comprises evaluating the ground reinforcement effect in the ground reinforcement zone by comparing the electrical resistivity of pre-reinforcement and the electrical resistivity of post-reinforcement on the basis of a characteristic that the electrical resistivity of the mortar is lower than the electrical resistivity of underground water existing in a limestone cavity.

* * * * *